US006382421B1

(12) United States Patent
Dao

(10) Patent No.: US 6,382,421 B1
(45) **Date of Patent: *May 7, 2002**

(54) SCHOOL SUPPLIES CONTAINER

(76) Inventor: Tony Dao, 7409 Wright Rd., Suite A, Houston, TX (US) 77040-9998

( * ) Notice: Subject to any disclaimer, the term of this patent is extended or adjusted under 35 U.S.C. 154(b) by 0 days.

This patent is subject to a terminal disclaimer.

(21) Appl. No.: 09/586,105

(22) Filed: Jun. 2, 2000

Related U.S. Application Data

(63) Continuation-in-part of application No. 09/569,018, filed on May 11, 2000, now abandoned.

(51) Int. Cl.[7] ..... B44D 3/00
(52) U.S. Cl. ..... 206/575; 206/1.7; 206/371
(58) Field of Search ..... 206/1.7, 1.8, 371, 206/575, 579, 751, 754, 755

(56) References Cited

U.S. PATENT DOCUMENTS 2,427,218 A * 9/1947 Liebson ..... 206/755
2,552,170 A * 5/1951 Gusmorino ..... 206/755
2,940,200 A * 6/1960 Endlich ..... 206/1.7
4,006,821 A * 2/1977 Sautter ..... 206/755
5,257,721 A * 11/1993 Smith et al. ..... 206/575
5,676,254 A * 10/1997 Cheng et al. ..... 206/751
5,957,291 A * 9/1999 Whitfield, Sr. ..... 206/579
6,026,960 A * 2/2000 Cogliano ..... 206/575
6,105,770 A * 8/2000 Vasudeva ..... 206/378

FOREIGN PATENT DOCUMENTS

GB 118311 * 5/1893 ..... 206/1.7

* cited by examiner

*Primary Examiner*—David T. Fidei

(57) ABSTRACT

An apparatus for containing articles of school supplies comprising a walled structure forming an inner compartment having one or more receptacles adapted to receive an article of school supplies. At least one receptacle being adapted for automatic movement within the inner compartment. A latchable cover is also provided to seal the walled structure and protect articles within the inner compartment.

9 Claims, 2 Drawing Sheets

FIG. 3a
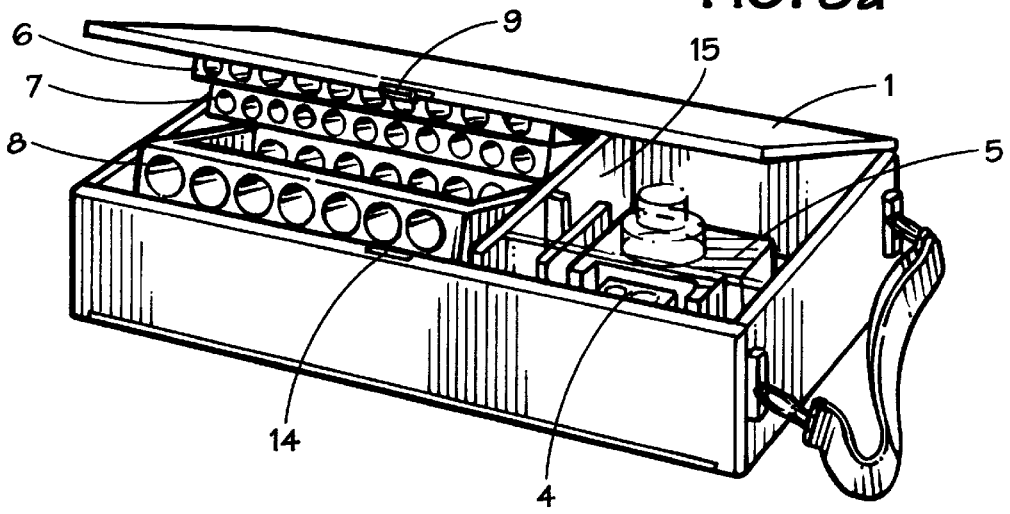
FIG. 3b
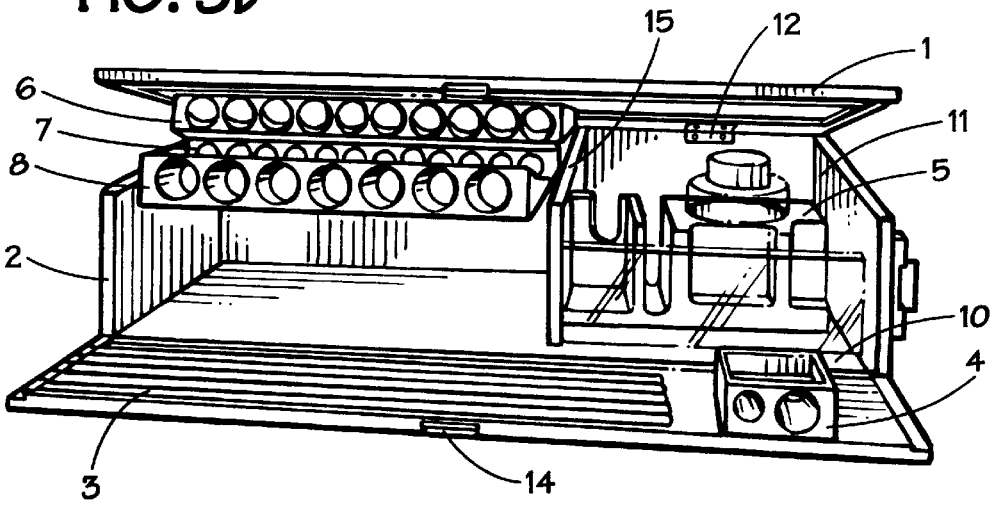
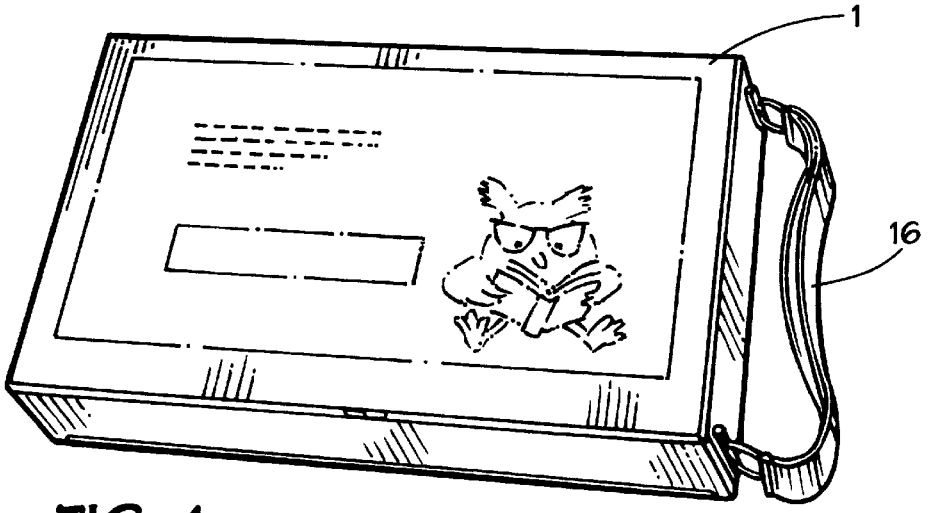
FIG. 4

SCHOOL SUPPLIES CONTAINER

CROSS-REFERENCES

This present application is a continuation-in-part of U.S. application Ser. No. 09/569,018 filed on May 11, 2000, hereby abandoned without prejudice.

BACKGROUND OF THE INVENTION

1. Field of the Invention

This invention relates generally to the field of education, and, more particularly to container apparatus for transporting and/or storing school supplies.

2. Description of Related Art

Students starting pre-school and progressing onward through school have been required to learn to use many various designs, sizes and shapes of essential school supplies comprising such items as color crayons, pencils, ink pens, protractors, compasses, glue, and paste. Methods for preservation, storing and transporting of these essential school supplies typically involved individual pre-packaged containers for each item that resulted in loss and damage to the school supplies.

Conventional container apparatus for essential school supplies consist of factory packaging containers made of light gauge cardboard. These containers are typically short lived due to their fragile construction and repetitive handling. Another known container is the old metal pencil box, which is limited to holding pencils only.

These known container apparatus are deficient in that they do not provide adequate protection for the individually housed items. The user is also hindered by having to maintain many individual containers of various sizes and shapes. Typically damage and loss occurs, which results in replacement costs for the individually package items.

It is desirable to obtain a safe, durable, reliable and easy to use, container apparatus for storing and/or transporting school supplies. Thus, there remains a need for an improved school supplies container.

SUMMARY OF THE INVENTION

An object of the invention is to provide a container for school supplies that is economical to buy and easy to use.

Another object of the invention is to provide a durable, safe container for school supplies.

Another object of the invention is to provide a container that can conveniently store various sizes of essential school supplies.

Another object of the invention is to provide a container that is lightweight for easy carrying from place to place.

A further object of the invention is to provide a container that is transparent for ease of visual inspection of contents.

Yet another object of the invention is to provide a container that protects the housed school supplies from damage and loss.

Still another object of the invention is to provide a container that encourages the organizing of school supplies within its compartment(s).

The invention provides an apparatus for containing articles of school supplies, comprising a walled structure forming an inner compartment; said inner compartment having at least one receptacle adapted to receive an article of school supplies; said at least one receptacle being adapted to move within said inner compartment; and a lid to cover said inner compartment.

The invention also provides an apparatus for containing articles of school supplies, comprising a cover; a bottom; a plurality of wall sections connected between said cover and said bottom so as to form an inner compartment; said inner compartment having at least one receptacle pivotably mounted therein; and said at least one receptacle being adapted to receive an article of school supplies.

The invention also provides an apparatus for containing articles of school supplies, comprising a base; a surface mounted to said base such that a walled inner compartment is formed; a cover connected to said surface opposite said base, said cover being adapted for movement between a closed and opened position; and at least one receptacle pivotably mounted within said inner compartment, wherein said at least one receptacle is adapted to receive an article of school supplies.

BRIEF DESCRIPTION OF THE DRAWINGS

Other objects and advantages of the invention will become apparent upon reading the following detailed description and upon reference to the drawings in which:

FIG. 3*a* is a perspective view of a container apparatus of the invention with its cover in a semi-closed position in accord with the invention.

FIG. 3*b* is a front view of a container apparatus of the invention with its front wall section in the open position in accord with the invention.

FIG. 4 is a perspective view of a container apparatus of the invention with its cover in the closed position in accord with the invention.

DETAILED DESCRIPTION OF SPECIFIC EMBODIMENTS

In the interest of clarity, not all features of actual implementation are described in this specification. It will be appreciated that although the development of any such actual implementation might be complex and time-consuming, it would nevertheless be a routine undertaking for those of ordinary skill in the art having the benefit of this disclosure.

Figure 1:
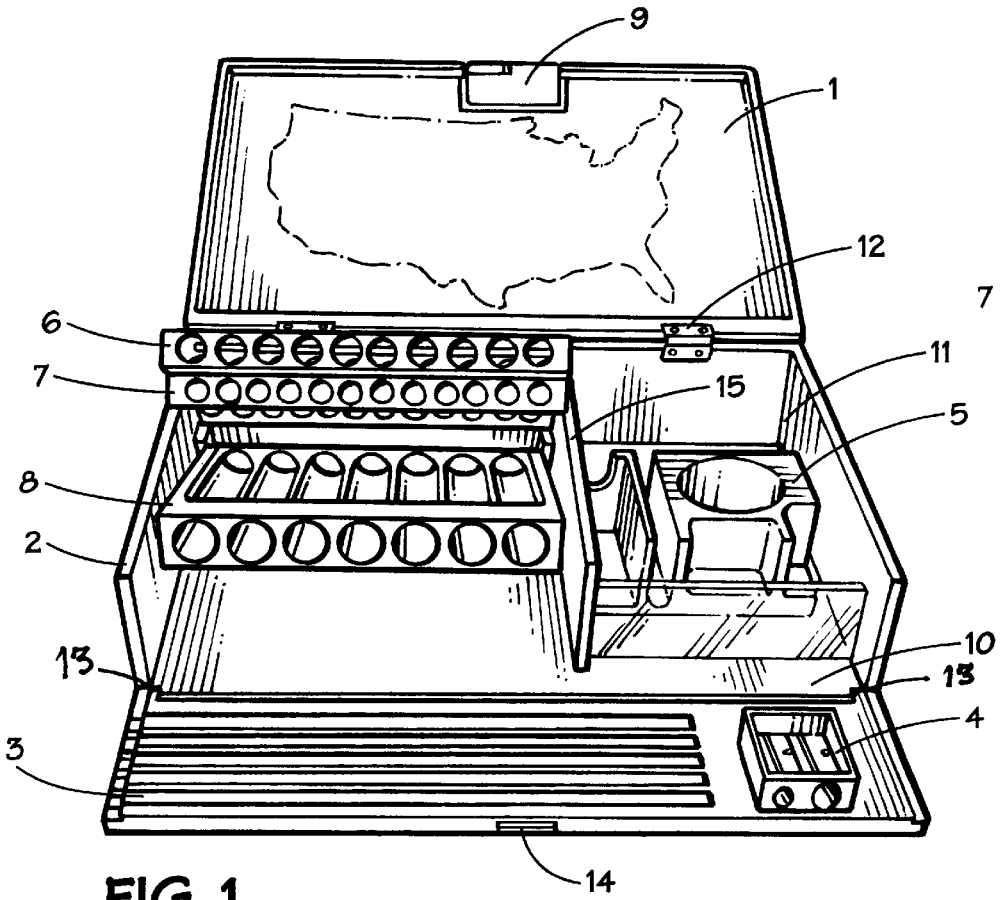
FIG. 1 is a perspective view of a container apparatus in accord with the invention.

FIG. 1 shows an embodiment of the invention. A container for transporting and/or storing articles of school supplies comprises four wall sections 2 connected to a base 10 to form a walled box-type structure. The base 10 and wall sections 2 are made of a commercially available flexible or semi-flexible plastic material. Clear, colored, or opaque plastic materials may be used. More rigid plastics such as plexiglass or any suitable polymer may also be used to form the base 10 and/or wall sections 2. Alternatively, the base 10 and wall sections 2 may be formed of metal. Depending on the molding or fabrication process used to construct the invention, the wall sections 2 may also be formed as a one-piece surface (not shown).

The wall sections 2 are connected to the base 10 using an appropriate glue. The wall sections 2 may also be connected to base 10 using appropriate fasteners such as rivets or screws (not shown). If the base 10 and wall sections 2 are formed of metal, they may be connected using welding techniques.

Figure 2:
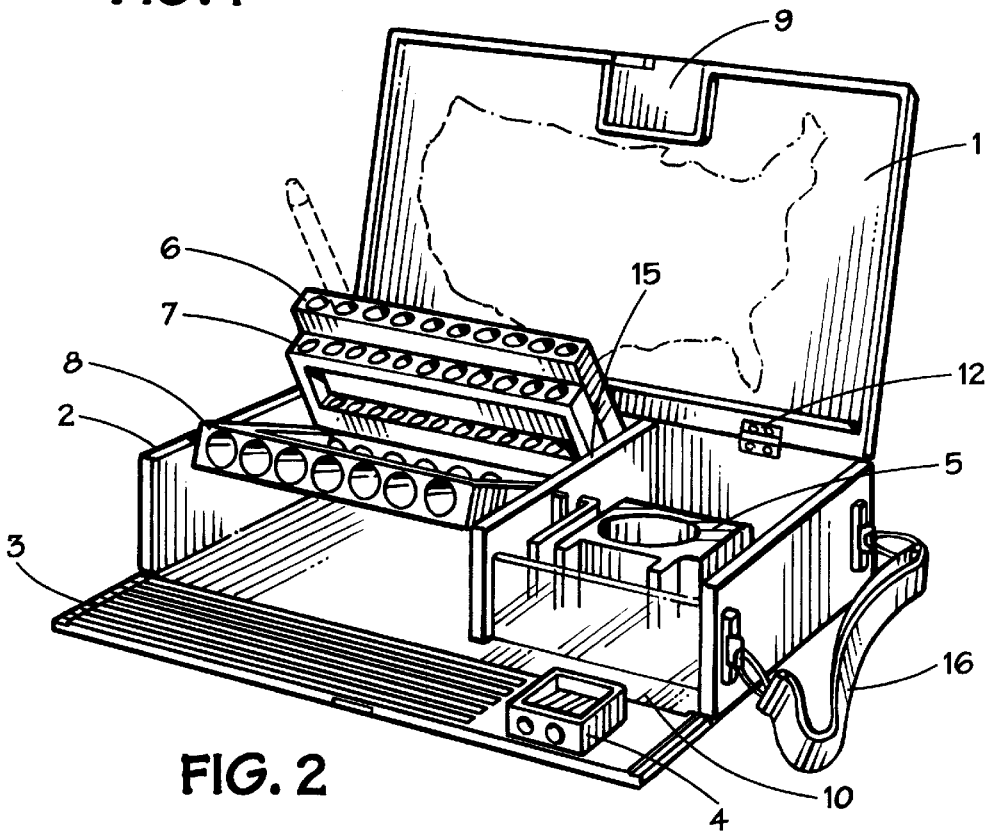
FIG. 2 is a plan view of a container apparatus of the invention after contents have been inserted in accord with the invention.

The walled structure formed by the base 10 and wall sections 2 forms an inner compartment 11. Within the inner compartment 11 are mounted several dedicated sized receptacles 5, 6, 7, 8. These receptacles may be formed of the same materials described above with regard to the base 10 and wall sections 2. The receptacles 6, 7, 8 have rectangular bodies with cylindrical perforations for receiving one or more articles of school supplies, as shown in FIGS. 2 and 3*a*–3*b*. One or more receptacles 5 may be rigidly mounted within the inner compartment 11 while others are configured for movement as described below. It will be understood that the receptacles 5, 6, 7, 8 may be configured in various shapes and/or dimensions and sized to receive and contain any of numerous articles of school supplies.

A cover or lid 1 is attached to one of the wall sections 2. The cover 1 may also be formed of the materials described above. The cover 1 is permanently attached to the wall section 2 by one or more hinges 13 so that the cover is free to move between a closed and opened position. Other suitable means may be used to attach the cover 1 to the wall section 2, including a plastic seam. Alternatively, the cover 1 may not be connected to a wall section 2 and left free for complete removal.

The cover includes a latch 9 at the lip opposite the hinge(s) 12. The latch 9 maintains the cover 9 secured when in the closed position. Most commercially available latch means may be used, a preferable latch 9 includes spring means to provide resistance against inadvertent opening of the cover 1.

As shown in FIG. 1, a front wall section 2 is configured so that it pivots about a connecting axis, thus providing greater access to the inner compartment 11. The front wall section 2 is formed having extending pins or tabs 13 that connect into corresponding holes or receptacles formed in the base 10. The pivoting front wall section 2 also has a tab or notch 14 at the outer lip to connect with the latch 9 on the cover 1 when the front wall section 2 is in the upright position and the cover 1 is in the closed position, as shown in FIG. 4. Grooves 3 may also be formed in the front wall section 2 to receive one or more pens or pencils as shown in FIG. 2. Additional articles of school supplies may also be affixed to the front wall section, including a pencil sharpener 4 or other suitable articles of school supplies.

A divider 15 is also mounted to the base 10 within the inner compartment 11. The divider 15 may likewise made of any of the materials described above. The divider 15 subdivides the inner compartment 11 and provides a mounting surface for one end of the receptacles 6, 7, 8. As shown in FIG. 1, the receptacles 6, 7, 8 are mounted between a wall section 2 and the divider 15. The receptacles 6, 7, 8 are mounted within the inner compartment 11 by pins at the ends of the rectangular bodies (not shown). The pins fit into corresponding holes (not shown) in the wall section 2 and divider 15. The pin-hole connection provides the receptacles 6, 7, 8 a pivot axis so that the receptacles 6, 7, 8 are free to move or pivot within the inner compartment 11. Additional dividers 15 may be mounted within the inner compartment 11 as desired, including clear or colored dividers having different dimensions and/or shapes.

By placing the pin-hole connection at the upper end of each receptacle 6, 7, 8, the receptacle's center of gravity is shifted so that its bottom end will naturally tilt downward when unrestricted. In this manner, the receptacles 6, 7, 8 will automatically move to an elevated position when the cover 1 is moved to the opened position. Thus, providing easier access to the articles of school supplies contained within the receptacles 6, 7, 8. When the cover 1 is moved to the closed position, the cover 1 pushes down against the receptacles 6, 7, 8, causing them to automatically retract into the inner compartment 11.

Turning to FIG. 2, an embodiment of the invention is shown having various articles opf school supplies stored therein. FIG. 2 also shows a strap 16 connected to the exterior of a wall section 2. The strap 16 is made of any suitable commercially available material such as nylon and is connected to the wall section 2 using conventional connector clips that are sewn or affixed to the ends of the strap 16. The connector clips connect to corresponding eyelets or receptacles that are glued or mounted onto the exterior of the wall section 2. The length of the strap 16 may be adjusted to shoulder length or for handle transport as desired. FIG. 2 shows the receptacles 6, 7, 8 containing a multitude of color crayons in the elevated position.

FIGS. 3*a*–3*b* respectively show an embodiment of the invention in a semi-closed position and with the front wall section 2 in a lowered position. As shown in FIGS. 3*a*–3*b*, when the cover 1 is transitioning from the open to the closed position, it pushes the receptacles 6, 7, 8 into a retracted position for compact and convenient storage and portability.

FIG. 4 shows a top view of an embodiment of the invention. As described above, the entire structure of the invention may be formed of a see-through material so that its contents and/or a personal address and identification label may be readily viewable. The embodiment shown in FIG. 4 is formed of metal and shows a label affixed to the cover 1. FIG. 4 also provides another view of the strap 16.

The disclosed invention provides an easy to use carrier for preservation, storing and transporting essential articles of school supplies. The invention provides a structure that encourages the organizing within of these essential school supplies, providing a subtle training aid to assist students in keeping their school supplies and other items orderly and organized. The invention also provides a structure that reduces costs for those that purchase and maintain the inventory of school supplies within the container. The invention further provides a structure that prevents damage and loss of essential school supplies.

The particular embodiments disclosed above are illustrative only, as the invention may be modified and practiced in different but equivalent manners apparent to those skilled in the art having the benefit of the teachings herein. For example, the moveable and/or fixed receptacles adapted to receive the articles of school supplies may be mounted to the cover or the wall section in addition to the base and dividers. Additional pen and pencil grooves may also be formed in the cover. The carrier of the invention may also be configured in other shapes, including a circular, elliptical or square form.

Furthermore, no limitations are intended to the details of construction or design herein shown, other than as described in the claims below. It is therefore evident that the particular embodiments disclosed above may be altered or modified and all such modifications, equivalents, and alternatives are considered within the scope of the invention as defined by the appended claims.

What is claimed is:

1. An apparatus for containing articles of school supplies, comprising:

a walled structure forming an inner compartment;

wherein a first section of said walled structure is pivotably connected to a second section of said walled structure such that said first section may be selectively opened to facilitate access to said inner compartment;

a lid to cover said inner compartment;

said inner compartment having a plurality of receptacles, each said receptacle being adapted to receive an article of school supplies; and each said receptacle being disposed within said inner compartment such that said receptacle moves autonomously within said inner compartment from a retracted to an elevated position when said lid is lifted to expose said inner compartment.

2. The apparatus of claim 1, wherein said walled structure is formed from one of a flexible, semi-flexible, or metallic material.

3. The apparatus of claim 1, said walled structure further comprising a strap or handle mounted on the exterior of said structure.

4. The apparatus of claim 1, wherein said walled structure is formed in a rectangular or circular configuration.

5. The apparatus of claim 1, wherein said lid is permanently mounted to said walled structure about a hinged axis to permit selective access to said inner compartment.

6. The apparatus of claim 5, wherein said lid is adapted with latching means to latch said lid against said walled structure when said lid is covering said inner compartment.

7. The apparatus of claim 1, said inner compartment further comprising at least one divider mounted therein to subdivide said inner compartment.

8. The apparatus of claim 7, where said at least one divider is formed of a clear material.

9. The apparatus of claim 1, said inner compartment further comprising at least one rigidly mounted receptacle adapted to receive an article of said school supplies.

* * * * *